US010436199B2

(12) United States Patent
Morishita et al.

(10) Patent No.: US 10,436,199 B2
(45) Date of Patent: Oct. 8, 2019

(54) ROTARY COMPRESSOR

(71) Applicant: FUJITSU GENERAL LIMITED, Kawasaki-shi, Kanagawa (JP)

(72) Inventors: Taku Morishita, Kanagawa (JP); Naoya Morozumi, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 31 days.

(21) Appl. No.: 15/380,325

(22) Filed: Dec. 15, 2016

(65) Prior Publication Data

US 2017/0175742 A1 Jun. 22, 2017

(30) Foreign Application Priority Data

Dec. 21, 2015 (JP) ..... 20145-249118

(51) Int. Cl.
*F04C 29/12* (2006.01)
*F04C 18/356* (2006.01)
(Continued)

(52) U.S. Cl.
CPC ..... *F04C 27/001* (2013.01); *F04C 18/3564* (2013.01); *F04C 23/001* (2013.01); *F04C 23/008* (2013.01); *F04C 29/025* (2013.01); *F04C 29/124* (2013.01); *F04C 29/065* (2013.01); *F04C 29/12* (2013.01); *F04C 2240/20* (2013.01); *F04C 2240/30* (2013.01); *F04C 2240/60* (2013.01)

(58) Field of Classification Search
CPC .... F04C 18/3564; F04C 29/124; F04C 18/22; F04C 29/12; F04C 23/001; F04C 29/065; F04C 29/068; F04C 18/344; F01C 1/44; F01C 1/46
USPC ..... 418/11, 13, 60, 63, 96, 94
See application file for complete search history.

(56) References Cited

U.S. PATENT DOCUMENTS 4,726,739 A * 2/1988 Saitou ..... F04C 18/3564 417/286
5,242,280 A * 9/1993 Fujio ..... F04C 18/3564 418/11

(Continued)

FOREIGN PATENT DOCUMENTS

CN 101835987 A 9/2010
CN 102808768 A 12/2012

(Continued)

OTHER PUBLICATIONS

Extended European Search Report issued in corresponding EP Application No. 16205402.7, dated Mar. 14, 2017.

(Continued)

*Primary Examiner* — Deming Wan
(74) *Attorney, Agent, or Firm* — McDermott Will & Emery LLP

(57) ABSTRACT

In a rotary compressor, a protruding portion which protrudes downward from a bottom end of a rotation shaft and in which an outer diameter is smaller than an outer diameter of a sub-bearing unit is formed on the sub-bearing unit which is provided on a lower end plate, a step portion is formed between the protruding portion and the sub-bearing unit, and a center hole of a lower end plate cover is caused to mate with the protruding portion and is caused to come into close contact with the step portion.

4 Claims, 4 Drawing Sheets

(51) Int. Cl.

| | |
|---|---|
| ***F01C 1/46*** | (2006.01) |
| ***F04C 29/06*** | (2006.01) |
| ***F04C 23/00*** | (2006.01) |
| ***F04C 18/344*** | (2006.01) |
| ***F04C 27/00*** | (2006.01) |
| ***F04C 29/02*** | (2006.01) |

(56) References Cited

U.S. PATENT DOCUMENTS

| | | | | |
|---|---|---|---|---|
| 6,102,677 | A * | 8/2000 | Iida | F04C 18/10 417/410.3 |
| 8,979,517 | B2 * | 3/2015 | Omura | F04C 29/128 418/11 |
| 2010/0278674 | A1 | 11/2010 | Byun et al. | |
| 2010/0310388 | A1 * | 12/2010 | Yuasa | F04C 18/3564 417/312 |
| 2012/0308425 | A1 | 12/2012 | Morishita | |
| 2015/0233376 | A1 | 8/2015 | Ogata et al. | |
| 2016/0131137 | A1 | 5/2016 | Komai et al. | |

FOREIGN PATENT DOCUMENTS

| | | | |
|---|---|---|---|
| CN | 104011393 | A | 8/2014 |
| CN | 105164422 | A | 12/2015 |
| JP | 04-187887 | A | 7/1992 |
| JP | 2007-113542 | A | 5/2007 |
| JP | 2007-187085 | A | 7/2007 |
| JP | 2012-202237 | A | 10/2012 |
| JP | 2013-076337 | A | 4/2013 |
| JP | 2013-245628 | A | 12/2013 |
| WO | 2009/061038 | A1 | 5/2009 |

OTHER PUBLICATIONS

Japanese Office Action issued in corresponding Japanese Patent Application No. 2015-249118, dated Jan. 22, 2019, with English Translation.

Chinese Office Action issued in corresponding Chinese Patent Application No. 201611115372.4, dated Jan. 29, 2019, with English Translation.

* cited by examiner

ROTARY COMPRESSOR

CROSS-REFERENCE TO RELATED APPLICATION

This application is based upon and claims the benefit of priorities from Japanese Patent Application No. 2015-249118 filed on Dec. 21, 2015; the entire contents of which are incorporated herein by reference.

FIELD

The present invention relates to a rotary compressor (hereinafter, also referred to simply as a "compressor") which is used in an air conditioner, a refrigerating machine, or the like.

BACKGROUND

For example, JP-A-2012-202237 describes a rotary compressor including a compressing unit disposed on the bottom portion of a compressor housing, compresses a refrigerant gas, and discharges the compressed refrigerant gas into the compressor housing via an upper muffler cover and a lower muffler cover (upper end plate cover, and a lower end plate cover); a motor disposed on the top portion of the compressor housing and drives the compressing unit via a rotation shaft; a lubricant oil stored on a bottom of the compressor housing; and a spiral-shaped pump impeller (oil feeding impeller) inserted (press-fitted) into a shaft hole (oil feeding vertical hole) of the bottom portion of the rotation shaft, and sucks up the lubricant oil from an inlet of the lower muffler cover into the shaft hole through the rotation of the rotation shaft to feed the lubricant oil to the compressing unit. In the rotary compressor, the inlet of the lower muffler cover is a cylindrical hole which protrudes downward.

However, the rotary compressor described in JP-A-2012-202237 performs the sealing of a lower muffler cover chamber (lower end plate cover chamber) by causing the lower end surface of a sub-bearing unit of a lower end plate to come into contact with the lower muffler cover (lower end plate cover). Therefore, there is a problem in that, in a case in which the sealing is insufficient, the refrigerant gas inside the lower muffler cover chamber leaks, flows into the shaft hole of the bottom portion of the rotation shaft, and mixes with the lubricant oil which is sucked up into the shaft hole, resulting in a negative influence on the lubrication of the compressing unit.

SUMMARY

An object of the present invention is to obtain a rotary compressor in which a refrigerant gas does not easily flow into a shaft hole (oil feeding vertical hole) of the bottom portion of a rotation shaft, even if the refrigerant gas inside a lower muffler cover chamber (lower end plate cover chamber) leaks.

The present invention is a rotary compressor which includes a sealed vertically-placed cylindrical compressor housing in which a discharge pipe which discharges a refrigerant is provided on a top portion and an upper inlet pipe and a lower inlet pipe which suck in the refrigerant are provided on bottom portions of side surfaces; an accumulator which is fixed to a side portion of the compressor housing and is connected to the upper inlet pipe and the lower inlet pipe; a motor which is disposed inside the compressor housing; and a compressing unit which is disposed beneath the motor inside the compressor housing, is driven by the motor, sucks in the refrigerant from the accumulator via the upper inlet pipe and the lower inlet pipe, compresses the refrigerant, and discharges the refrigerant from the discharge pipe, in which the compressing unit includes an upper cylinder and a lower cylinder which are formed in ring shapes, an upper end plate which blocks a top side of the upper cylinder and a lower end plate which blocks a bottom side of the lower cylinder, an intermediate partition plate which is disposed between the upper cylinder and the lower cylinder and blocks a bottom side of the upper cylinder and a top side of the lower cylinder, a rotation shaft which includes, in an inner portion thereof, an oil feeding vertical hole into which an oil feeding impeller is press-fitted and an oil feeding horizontal hole which communicates with the oil feeding vertical hole, whose main shaft unit is supported by a main bearing unit provided on the upper end plate, whose sub-shaft unit is supported by a sub-bearing unit provided on the lower end plate, and which is driven by the motor, an upper eccentric portion and a lower eccentric portion which are provided on the rotation shaft with a mutual phase difference of 180°, an upper piston which mates with the upper eccentric portion, revolves along an inner circumferential surface of the upper cylinder, and forms an upper cylinder chamber inside the upper cylinder, a lower piston which mates with the lower eccentric portion, revolves along an inner circumferential surface of the lower cylinder, and forms a lower cylinder chamber inside the lower cylinder, an upper vane which protrudes into the upper cylinder chamber from an upper vane groove which is provided in the upper cylinder, comes into contact with the upper piston, and partitions the upper cylinder chamber into an upper inlet chamber and an upper compression chamber, a lower vane which protrudes into the lower cylinder chamber from a lower vane groove which is provided in the lower cylinder, comes into contact with the lower piston, and partitions the lower cylinder chamber into a lower inlet chamber and a lower compression chamber, an upper end plate cover which covers the upper end plate to form an upper end plate cover chamber between the upper end plate cover and the upper end plate, and includes an upper end plate cover discharge hole which communicates with the upper end plate cover chamber and an inner portion of the compressor housing, a lower end plate cover which covers the lower end plate and forms a lower end plate cover chamber between the lower end plate cover and the lower end plate, an upper discharge hole which is provided in the upper end plate and which communicates with the upper compression chamber and the upper end plate cover chamber, a lower discharge hole which is provided in the lower end plate and which communicates with the lower compression chamber and the lower end plate cover chamber, a refrigerant path hole which penetrates the lower end plate, the lower cylinder, the intermediate partition plate, the upper end plate, and the upper cylinder, and communicates with the lower end plate cover chamber and the upper end plate cover chamber, and a reed valve type upper discharge valve which opens and closes the upper discharge hole, and a reed valve type lower discharge valve which opens and closes the lower discharge hole, in which a protruding portion which protrudes downward from a bottom end of the rotation shaft and in which an outer diameter D2 is smaller than an outer diameter D1 of the sub-bearing unit, is formed on the sub-bearing unit which is provided on the lower endplate and a step portion is formed between the protruding portion and the sub-bearing unit, and, in which a center hole of the lower end plate cover is caused to mate with the protruding portion, and is caused to come into close contact with to the step portion.

In the rotary compressor according to the present invention, a refrigerant gas does not easily flow into the oil feeding vertical hole of the bottom portion of the rotation shaft, even if the refrigerant gas inside the lower end plate cover chamber leaks.

DESCRIPTION OF EMBODIMENTS

Hereafter, detailed description will be given of embodiments (examples) for realizing the present invention with reference to the drawings.

EXAMPLE

Figure 1:
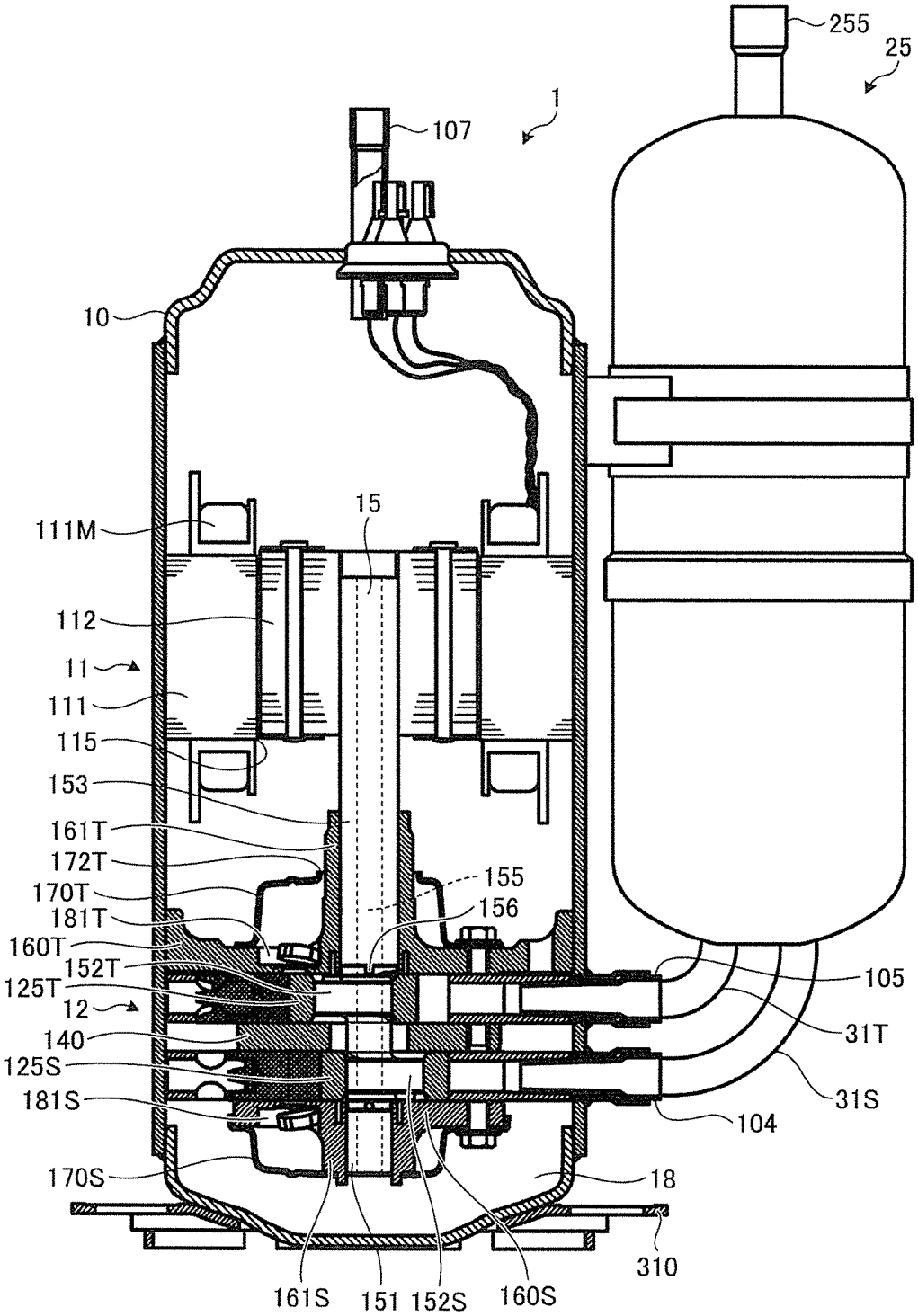
FIG. 1 is a vertical sectional view illustrating an example of a rotary compressor according to the present invention.
Figure 2:
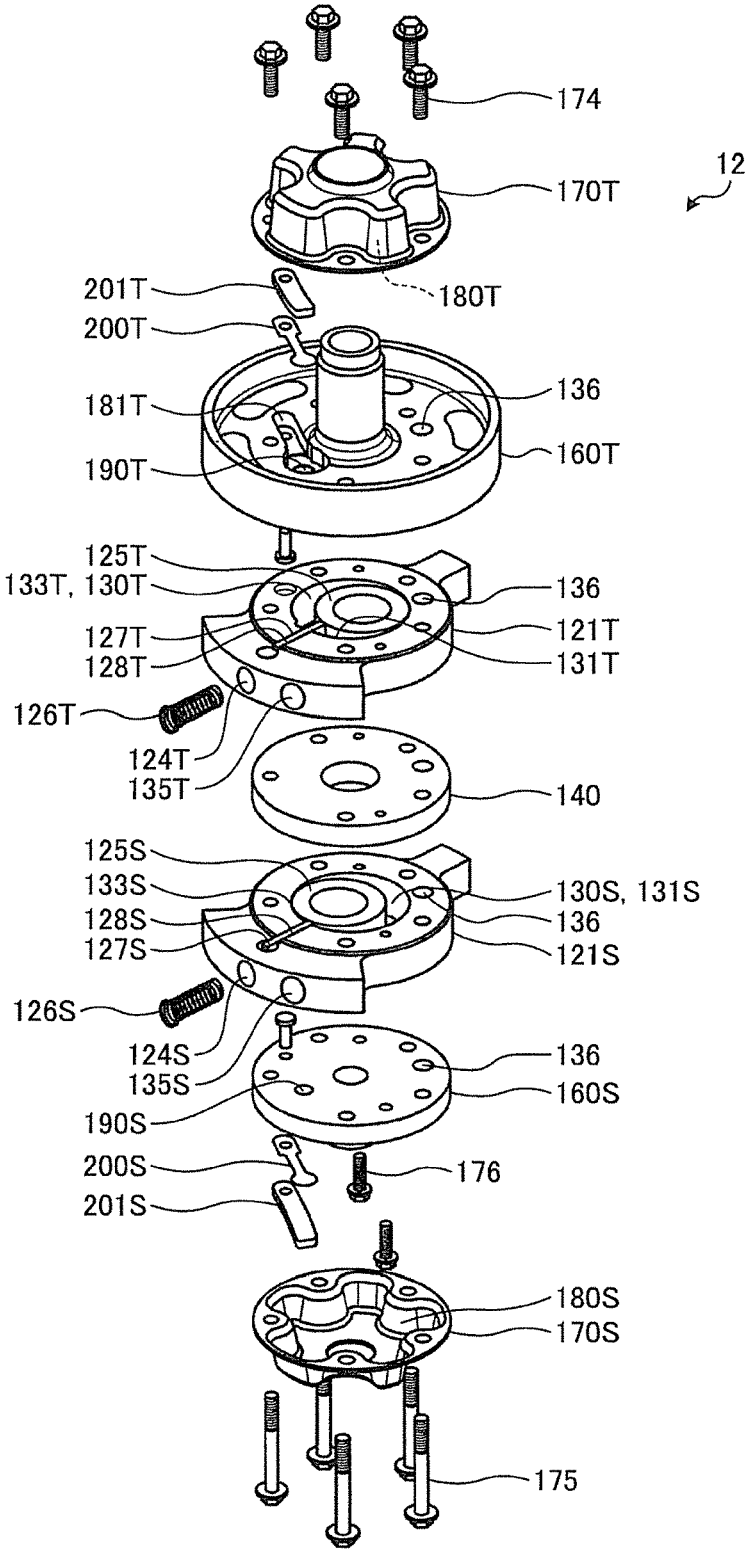
FIG. 2 is an upward exploded perspective view illustrating a compressing unit of the rotary compressor of the example.
Figure 3:
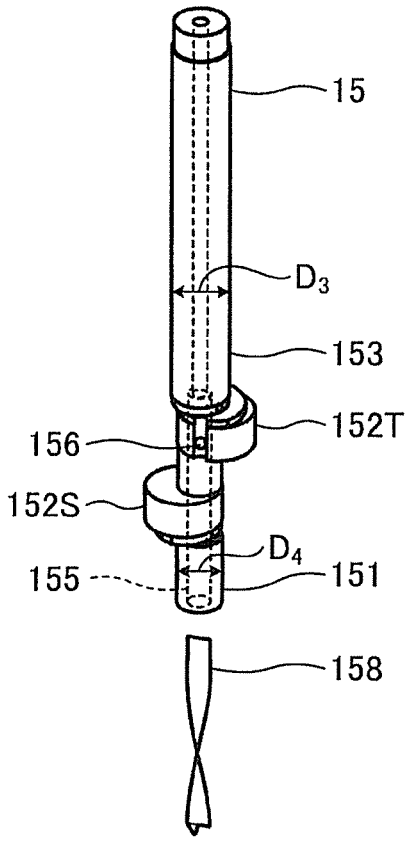
FIG. 3 is an upward exploded perspective view illustrating a rotation shaft and an oil feeding impeller of the rotary compressor of the example.
Figure 4:
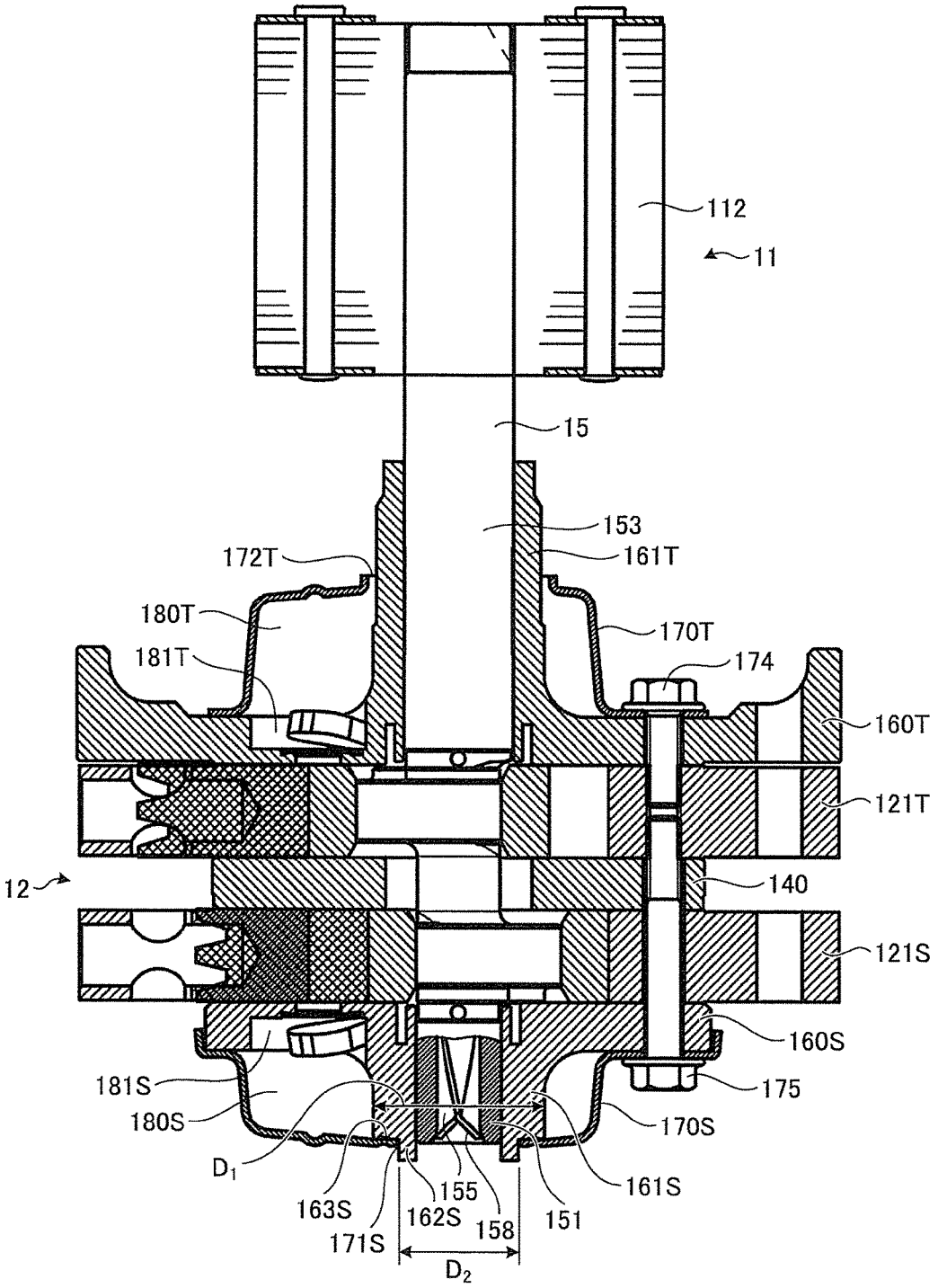
FIG. 4 is a vertical sectional view illustrating the compressing unit of the rotary compressor of the example.

FIG. 1 is a vertical sectional view illustrating an example of a rotary compressor according to the present invention. FIG. 2 is an upward exploded perspective view illustrating a compressing unit of the rotary compressor of the example. FIG. 3 is an upward exploded perspective view illustrating a rotation shaft and an oil feeding impeller of the rotary compressor of the example. FIG. 4 is a vertical sectional view illustrating the compressing unit of the rotary compressor of the example.

As illustrated in FIG. 1, a rotary compressor 1 is provided with a compressing unit 12, a motor 11, and a vertically-placed cylindrical accumulator 25. The compressing unit 12 is disposed on the bottom portion inside a sealed vertically-placed cylindrical compressor housing 10, the motor 11 is disposed above the compressing unit 12 and drives the compressing unit 12 via a rotation shaft 15, and the accumulator 25 is fixed to the side surface of the compressor housing 10.

The accumulator 25 is connected to an upper inlet chamber 131T (refer to FIG. 2) of an upper cylinder 121T via an upper inlet pipe 105 and an accumulator upper L-pipe 31T, and is connected to a lower inlet chamber 131S (refer to FIG. 2) of a lower cylinder 121S via a lower inlet pipe 104 and an accumulator lower L-pipe 31S.

A discharge pipe 107 for discharging a refrigerant to a refrigerant circuit (refrigeration cycle) of an air conditioner by penetrating the compressor housing 10 is provided in the center of the top portion of the compressor housing 10. An accumulator inlet pipe 255 for sucking in the refrigerant from the refrigerant circuit (refrigeration cycle) of the air conditioner by penetrating a housing of the accumulator 25 is provided in the center of the top portion of the accumulator 25.

The motor 11 is provided with a stator 111 on the outside, and a rotor 112 on the inside. The stator 111 is fixed by shrink-fitting to the inner circumferential surface of the compressor housing 10, and the rotor 112 is fixed by shrink-fitting to the rotation shaft 15.

In the rotation shaft 15, a sub-shaft unit 151 which is below a lower eccentric portion 152S is fitted and supported, in a free-rotating manner, into a sub-bearing unit 161S which is provided on a lower end plate 160S, a main shaft unit 153 which is above an upper eccentric portion 152T is fitted and supported, in a free-rotating manner, into a main bearing unit 161T which is provided on an upper end plate 160T, the upper eccentric portion 152T and the lower eccentric portion 152S, which are provided with a mutual phase difference of 180°, are fitted, in a free-rotating manner, to an upper piston 125T and a lower piston 125S, respectively, and thus, the rotation shaft 15 is supported to rotate freely in relation to the entire compressing unit 12. Due to rotation, the upper piston 125T and the lower piston 125S revolve along the inner circumferential surfaces of the upper cylinder 121T and the lower cylinder 121S, respectively.

With the aim of lubricating the sliding portions of the compressing unit 12 and sealing an upper compression chamber 133T (refer to FIG. 2) and a lower compression chamber 133S (refer to FIG. 2), an amount of a lubricant oil 18 sufficient to substantially immerse the compressing unit 12 is sealed in the inner portion of the compressor housing 10. An attachment leg 310 which locks a plurality of elastic supporting members (not illustrated) which support the entire rotary compressor 1 is fixed to the bottom side of the compressor housing 10.

As illustrated in FIG. 2, the compressing unit 12 is configured by stacking, in order from top, an upper end plate cover 170T including a dome-shaped bulging portion, the upper end plate 160T, the upper cylinder 121T, an intermediate partition plate 140, the lower cylinder 121S, the lower end plate 160S, and a lower end plate cover 170S including a dome-shaped bulging portion. The entire compressing unit 12 is fixed, from top and bottom, by a plurality of penetrating bolts 174 and 175 and auxiliary bolts 176 which are disposed in a substantially concentric manner.

An upper inlet hole 135T which mates with the upper inlet pipe 105 is provided in the ring-shaped upper cylinder 121T. A lower inlet hole 135S which mates with the lower inlet pipe 104 is provided in the ring-shaped lower cylinder 121S. The upper piston 125T is disposed in an upper cylinder chamber 130T of the upper cylinder 121T. The lower piston 125S is disposed in a lower cylinder chamber 130S of the lower cylinder 121S.

An upper vane groove 128T which extends from the upper cylinder chamber 130T to the outside in a radial manner is provided in the upper cylinder 121T, and an upper vane 127T is provided in the upper vane groove 128T. A lower vane groove 128S which extends from the lower cylinder chamber 130S to the outside in a radial manner is provided in the lower cylinder 121S, and a lower vane 127S is disposed in the lower vane groove 128S.

An upper spring hole 124T is provided in the upper cylinder 121T in a position which overlaps the upper vane groove 128T from the outside surface at a depth which does not penetrate the upper cylinder chamber 130T, and an upper spring 126T is disposed in the upper spring hole 124T. A lower spring hole 124S is provided in the lower cylinder 121S in a position which overlaps the lower vane groove 128S from the outside surface at a depth which does not penetrate the lower cylinder chamber 130S, and a lower spring 126S is disposed in the lower spring hole 124S.

The top and bottom of the upper cylinder chamber 130T are blocked by the upper end plate 160T and the intermediate partition plate 140, respectively. The top and bottom of the lower cylinder chamber 130S are blocked by the intermediate partition plate 140 and the lower end plate 160S, respectively.

Due to the upper vane 127T being pressed by the upper spring 126T and caused to abut the outer circumferential surface of the upper piston 125T by the upper spring 126T, the upper cylinder chamber 130T is partitioned into the upper inlet chamber 131T which communicates with the upper inlet hole 135T, and the upper compression chamber 133T which communicates with an upper discharge hole 190T which is provided in the upper end plate 160T. Due to the lower vane 127S being pressed by the lower spring 126S and caused to abut the outer circumferential surface of the lower piston 125S by the lower spring 126S, the lower cylinder chamber 130S is partitioned into the lower inlet chamber 131S which communicates with the lower inlet hole 135S, and the lower compression chamber 133S which communicates with a lower discharge hole 190S which is provided in the lower end plate 160S.

An upper end plate cover chamber 180T is formed on the exit side of the upper discharge hole 190T between the upper end plate 160T and the upper end plate cover 170T which includes a dome-shaped bulging portion, which are fixed to each other in close contact. The upper end plate cover chamber 180T is provided with a concave portion 181T on the upper end plate 160T. A reed valve type upper discharge valve 200T which prevents the refrigerant from backflowing in the upper discharge hole 190T and flowing into the upper compression chamber 133T, and an upper discharge valve cap 201T which restricts the opening degree of the upper discharge valve 200T are accommodated by the concave portion 181T.

A lower end plate cover chamber 180S is formed on the exit side of the lower discharge hole 190S between the lower endplate 160S and the lower endplate cover 170S which includes a dome-shaped bulging portion, which are fixed to each other in close contact. The lower end plate cover chamber 180S is provided with a concave portion 181S (refer to FIG. 1) on the lower endplate 160S. A reed valve type lower discharge valve 200S which prevents the refrigerant from backflowing in the lower discharge hole 190S and flowing into the lower compression chamber 133S, and a lower discharge valve cap 201S which restricts the opening degree of the lower discharge valve 200S are accommodated by the concave portion 181S.

A refrigerant path hole 136 is provided which penetrates the lower end plate 160S, the lower cylinder 121S, the intermediate partition plate 140, the upper end plate 160T, and the upper cylinder 121T and communicates with the lower end plate cover chamber 180S and the upper end plate cover chamber 180T.

As illustrated in FIG. 3, an oil feeding vertical hole 155 which penetrates from the bottom end to the top end is provided in the rotation shaft 15, and an oil feeding impeller 158 is press-fitted into the oil feeding vertical hole 155. A plurality of oil feeding horizontal holes 156 which communicate with the oil feeding vertical hole 155 are provided in the side surface of the rotation shaft 15. An outer diameter D4 of the sub-shaft unit 151 of the rotation shaft 15 is smaller than an outer diameter D3 of the main shaft unit 153. This is in order to reduce the sliding resistance of the sub-shaft unit 151 to less than the sliding resistance of the main shaft unit 153.

In the related art, an oil feeding pipe (not illustrated) is mounted to the bottom end portion of the oil feeding vertical hole 155 of the rotation shaft 15 such that it is possible to suck in the lubricant oil 18 even when the oil level of the lubricant oil 18 is low. However, if the outer diameter D4 of the sub-shaft unit 151 is small and the thickness is thin, when the oil feeding pipe is press-fitted into the oil feeding vertical hole 155, the sub-shaft unit 151 deforms, becoming a cause of an increase in the sliding resistance of the rotation shaft 15 and a decrease in the reliability of the sliding portions. As described in JP-A-2012-202237, a rotary compressor to which an oil feeding pipe is not mounted is proposed; however, such a rotary compressor has the problem described earlier in "2. BACKGROUND ART".

Next, description will be given of the flow of the refrigerant caused by the rotation of the rotation shaft 15. The upper piston 125T which is mated with the upper eccentric portion 152T of the rotation shaft 15 revolves along the outer circumferential surface of the upper cylinder chamber 130T (inner circumferential surface of the upper cylinder 121T) through the rotation of the rotation shaft 15 inside the upper cylinder chamber 130T. Accordingly, the upper inlet chamber 131T sucks in the refrigerant from the upper inlet pipe 105 while expanding in volume, and the upper compression chamber 133T compresses the refrigerant while shrinking in volume. If the pressure of the compressed refrigerant becomes higher than the pressure of the upper end plate cover chamber 180T of the outside of the upper discharge valve 200T, the upper discharge valve 200T opens, and the refrigerant is discharged from the upper compression chamber 133T to the upper end plate cover chamber 180T. The refrigerant which is discharged to the upper end plate cover chamber 180T is discharged from an upper end plate cover discharge hole 172T (refer to FIG. 1) which is provided in the upper end plate cover 170T into the inner portion of the compressor housing 10.

The lower piston 125S which is mated with the lower eccentric portion 152S of the rotation shaft 15 revolves along the outer circumferential surface of the lower cylinder chamber 130S (inner circumferential surface of the lower cylinder 121S) through the rotation of the rotation shaft 15 inside the lower cylinder chamber 130S. Accordingly, the lower inlet chamber 131S sucks in the refrigerant from the lower inlet pipe 104 while expanding in volume, and the lower compression chamber 133S compresses the refrigerant while shrinking in volume. If the pressure of the compressed refrigerant becomes higher than the pressure of the lower end plate cover chamber 180S of the outside of the lower discharge valve 200S, the lower discharge valve 200S opens, and the refrigerant is discharged from the lower compression chamber 133S to the lower end plate cover chamber 180S. The refrigerant which is discharged to the lower end plate cover chamber 180S passes through the refrigerant path hole 136 and the upper end plate cover chamber 180T, and is discharged into the inner portion of the compressor housing 10 from the upper end plate cover discharge hole 172T (refer to FIG. 1) which is provided in the upper endplate cover 170T.

The refrigerant which is discharged into the compressor housing 10 passes through a top-bottom communicating cutout (not illustrated) which is provided in the outer circumference of the stator 111, a gap (not illustrated) in a stator winding 111M of the stator 111, or a gap 115 (refer to FIG. 1) between the stator 111 and the rotor 112, is guided to above the motor 11, and is discharged from the discharge pipe 107 of the top portion of the compressor housing 10.

Next, description will be given of the flow of the lubricant oil 18. The lubricant oil 18 passes from the bottom end of the rotation shaft 15, through the oil feeding vertical hole 155 and the plurality of oil feeding horizontal holes 156, is fed to the sliding surface between the sub-bearing unit 161S and the sub-shaft unit 151 of the rotation shaft 15, the sliding surface between the main bearing unit 161T and the main shaft unit 153 of the rotation shaft 15, the sliding surface between the lower eccentric portion 152S of the rotation shaft 15 and the lower piston 125S, and the sliding surface between the upper eccentric portion 152T and the upper piston 125T, and lubricates each of the sliding surfaces.

The oil feeding impeller 158 sucks up the lubricant oil 18 by applying a centrifugal force to the lubricant oil 18 inside the oil feeding vertical hole 155. Even in a case in which the lubricant oil 18 is discharged with the refrigerant from inside the compressor housing 10, and an oil level is lowered, the oil feeding impeller 158 serves to reliably supply the lubricant oil 18 to the sliding surfaces described above.

Next, description will be given of the characteristic configuration of the rotary compressor 1 of the example, with reference to FIG. 4. As illustrated in FIG. 4, a protruding portion 162S which protrudes downward from the bottom end of the rotation shaft 15 and in which an outer diameter D2 is smaller than an outer diameter D1 of the sub-bearing unit 161S is formed on the sub-bearing unit 161S which is provided on the lower end plate 160S. A step portion 163S is formed between the protruding portion 162S and the sub-bearing unit 161S. A center hole 171S of the lower end plate cover 170S is caused to mate with the protruding portion 162S, and is caused to come into close contact with the step portion 163S of the protruding portion 162S.

By adopting the configuration described above, the protruding portion 162S serves as a partitioning wall between the center hole 171S of the lower end plate cover 170S and the oil feeding vertical hole 155 of the rotation shaft 15. In a case in which the refrigerant gas inside the lower end plate cover chamber 180S leaks from the center hole 171S of the lower endplate cover 170S, the refrigerant gas abuts the protruding portion 162S and spreads outward. Accordingly, it is possible to prevent the leaked refrigerant gas from flowing in from the oil feeding vertical hole 155 of the bottom end portion of the rotation shaft 15. Therefore, the refrigerant gas is not mixed with the lubricant oil which is sucked up from the bottom end portion of the rotation shaft 15, and does not negatively influence the lubrication of the compressing unit 12.

In the above, description is given of the examples; however, the examples are not limited by the previously-described content. The previously-described constituent elements include elements which are essentially the same, and so-called elements of an equivalent scope. It is possible to combine the previously-described constituent elements, as appropriate. It is possible to perform at least one of various omissions, replacements, modifications, and any combination thereof of the constituent elements in a scope that does not depart from the gist of the examples.

What is claimed is:

1. A rotary compressor comprising:

a sealed vertically-placed cylindrical compressor housing in which a discharge pipe which discharges a refrigerant is provided on a top portion and an upper inlet pipe and a lower inlet pipe which suck in the refrigerant are provided on bottom portions of side surfaces;

an accumulator which is fixed to a side portion of the compressor housing and which is connected to the upper inlet pipe and the lower inlet pipe;

a motor which is disposed inside the compressor housing; and a compressing unit which is disposed beneath the motor inside the compressor housing, is driven by the motor, sucks in the refrigerant from the accumulator via the upper inlet pipe and the lower inlet pipe, compresses the refrigerant, and discharges the refrigerant from the discharge pipe, wherein the compressing unit includes an upper cylinder and a lower cylinder which are formed in ring shapes;

an upper end plate which blocks a top side of the upper cylinder and a lower end plate which blocks a bottom side of the lower cylinder;

an intermediate partition plate which is disposed between the upper cylinder and the lower cylinder and blocks a bottom side of the upper cylinder and a top side of the lower cylinder;

a rotation shaft which includes, in an inner portion thereof, an oil feeding vertical hole into which an oil feeding impeller is press-fitted and an oil feeding horizontal hole which communicates with the oil feeding vertical hole, whose main shaft unit is supported by a main bearing unit provided on the upper end plate, whose sub-shaft unit is supported by a sub-bearing unit provided on the lower end plate, and which is driven by the motor;

an upper eccentric portion and a lower eccentric portion which are provided on the rotation shaft with a mutual phase difference of 180';

an upper piston which mates with the upper eccentric portion, revolves along an inner circumferential surface of the upper cylinder, and forms an upper cylinder chamber inside the upper cylinder;

a lower piston which mates with the lower eccentric portion, revolves along an inner circumferential surface of the lower cylinder, and forms a lower cylinder chamber inside the lower cylinder;

an upper vane which protrudes into the upper cylinder chamber from an upper vane groove which is provided in the upper cylinder, comes into contact with the upper piston, and partitions the upper cylinder chamber into an upper inlet chamber and an upper compression chamber;

a lower vane which protrudes into the lower cylinder chamber from a lower vane groove which is provided in the lower cylinder, comes into contact with the lower piston, and partitions the lower cylinder chamber into a lower inlet chamber and a lower compression chamber;

an upper end plate cover which covers the upper end plate to form an upper end plate cover chamber between the upper end plate cover and the upper end plate, and includes an upper end plate cover discharge hole which communicates with the upper end plate cover chamber and an inner portion of the compressor housing;

a lower end plate cover which covers the lower end plate and forms a lower end plate cover chamber between the lower end plate cover and the lower end plate;

an upper discharge hole which is provided in the upper end plate and which communicates with the upper compression chamber and the upper end plate cover chamber;

a lower discharge hole which is provided in the lower end plate and which communicates with the lower compression chamber and the lower end plate cover chamber;

a refrigerant path hole which penetrates the lower end plate, the lower cylinder, the intermediate partition plate, the upper end plate, and the upper cylinder, and communicates with the lower end plate cover chamber and the upper end plate cover chamber; and a reed valve type upper discharge valve which opens and closes the upper discharge hole, and a reed valve type lower discharge valve which opens and closes the lower discharge hole, wherein a protruding portion which protrudes downward from a bottom end of the rotation shaft and in which an outer diameter D2 of the protruding portion is smaller than an outer diameter D1 of the sub-bearing unit, is formed on the sub-bearing unit which is provided on the lower end plate and a step portion includes a lower surface and is formed between the protruding portion and the sub-bearing unit, and wherein the lower end plate cover has a center hole that extends through a thickness of the lower end plate cover, the center hole defined by a peripheral portion of the lower end plate cover that extends along only the lower surface of the step portion, wherein the center hole of the lower end plate cover is caused to mate with the protruding portion, such that an entire inner circumferential surface of the center hole along the entire thickness of the lower end plate cover is in face-to-face contact with an outer circumferential surface of the protruding portion and an upper surface of the peripheral portion of the lower end plate cover is in face-to-face contact with an entirety of the lower surface of the step portion, and the protruding portion protrudes downward beyond a lower surface of the peripheral portion of the lower end plate cover, such that a lower surface of the protruding portion is lower than the lower surface of the peripheral portion of the lower end plate cover.

2. The rotary compressor according to claim 1, wherein an outer diameter of the sub-shaft unit of the rotation shaft, is smaller than an outer diameter of the main shaft unit.

3. The rotary compressor according to claim 1, wherein the lower surface of the protruding portion is lower than the lower surface of the peripheral portion of the lower end plate cover by an amount that is larger than or equal to the thickness of the lower end plate cover.

4. The rotary compressor according to claim 1, wherein an opening at a bottom end of the oil feeding vertical hole of the rotation shaft is open inside the sub-bearing unit.

* * * * *